US006000158A

United States Patent [19]

Zoellner

[11] Patent Number: 6,000,158

[45] Date of Patent: Dec. 14, 1999

[54] PULL OUT IRONING BOARD

[76] Inventor: Weldon J. Zoellner, 12745 Alswell La., St. Louis, Mo. 63128

[21] Appl. No.: 09/135,276

[22] Filed: Aug. 17, 1998

[51] Int. Cl.[6] ..... D06F 81/02; D06F 81/06

[52] U.S. Cl. ..... 38/104; 108/40

[58] Field of Search ..... 38/106, 104, 112, 38/135, DIG. 2, 139; 108/40, 48, 47, 93, 157.12; 312/22, 21, 23, 25, 29

[56] References Cited

U.S. PATENT DOCUMENTS

| | | | |
|---|---|---|---|
| 1,415,529 | 5/1922 | Cronenberger | 38/104 X |
| 1,699,496 | 1/1929 | Wasmuth | 108/40 |
| 4,799,321 | 1/1989 | Johnson | 38/104 X |
| 5,241,766 | 9/1993 | Walz et al. | 38/104 |
| 5,444,928 | 8/1995 | Sagel | 38/104 X |
| 5,452,531 | 9/1995 | Graville et al. | 38/104 |
| 5,472,157 | 12/1995 | Lehrman | 38/104 X |

*Primary Examiner*—Ismael Izaguirre
*Attorney, Agent, or Firm*—Polster, Lieder, Woodruff & Lucchesi

[57] ABSTRACT

A removable ironing board (2) enclosed in a piece of furniture (1). The ironing board (2) is mounted on extendible rails (19 and 20) so that the ironing surface (2) projects out of the enclosure (3) when in use. A panel (4) is attached to the ironing surface(2), and is movable to a position underneath the ironing surface (2) when the ironing surface (2) is extended. The ironing board (2) may be replaced with a differently shaped ironing surface, or removed from the piece of furniture and the enclosure (3) used to house a drawer.

6 Claims, 2 Drawing Sheets

PULL OUT IRONING BOARD

CROSS-REFERENCE TO RELATED APPLICATIONS

None

STATEMENT REGARDING FEDERALLY SPONSORED RESEARCH OR DEVELOPMENT

Not Applicable.

BACKGROUND OF THE INVENTION

This invention relates to an ironing board, and in particular an ironing board built into a piece of furniture. The ironing board has a cabinet face covering the enclosure used to store the ironing board, and rails to extend and retract the ironing board out of and into the enclosure.

Ironing boards that are foldable or telescoping and are incorporated into furniture have been described, and include: U.S. Pat. No. 5,444,928 issued on Aug. 29, 1995, to Sagel; U.S. Pat. No. 5,241,766 issued on Sep. 7, 1993, to Waltz et al.; and U.S. Pat. No. 3,641,947 issued on Feb. 15, 1972 to Finney. These ironing boards have a seam on the working surface where the ironing board is folded, thus potentially causing unwanted creases to be formed in the article of clothing or material being ironed.

Previous ironing boards that are stored in cabinet like enclosures and are not folded are known in the art and include: U.S. Pat. No. 5,452,531 issued on Sep. 26, 1995 to Graville et al.; U.S. Pat. No. 4,049,332 issued on Sep. 20, 1977 to Bourdeaux; U.S. Pat. No. 5,241,766 issued on Sep. 7, 1993 to Waltz et al.; and U.S. Pat. No. 2,227,786 issued on Jan. 7, 1941 to LaFee. Each of these ironing boards is incorporated into furniture in a relatively permanent way, and removal of the ironing board assembly cannot be accomplished without the use of tools.

BRIEF SUMMARY OF THE INVENTION

An improved ironing board assembly is provided which is removably situated in a piece of furniture such as a dresser, cabinet or the like. The ironing board resides in a recessed enclosure, and is extendible from the enclosure by way of a pair of standard, heavy duty cabinetry rails. The ironing board has an attached cabinet face including handles to cover the enclosure's front opening when the ironing board is retracted. The ironing board is removable from the enclosure, allowing the user to replace the ironing board assembly with a differently sized ironing board or a drawer if desired, without using tools.

Among the several objects of the present invention are: The provision of an ironing board that may be stored within a piece of furniture when not in use;

the provision of an ironing board assembly that may be easily removed from an enclosure within a piece of furniture and replaced with a different ironing board or a drawer;

the provision of an ironing board that has an attached cabinet face cover;

the provision of an ironing board that is simple and inexpensive to manufacture;

and the provision of an ironing board that is sturdy and easy to use.

DETAILED DESCRIPTION OF THE INVENTION

Figure 1:
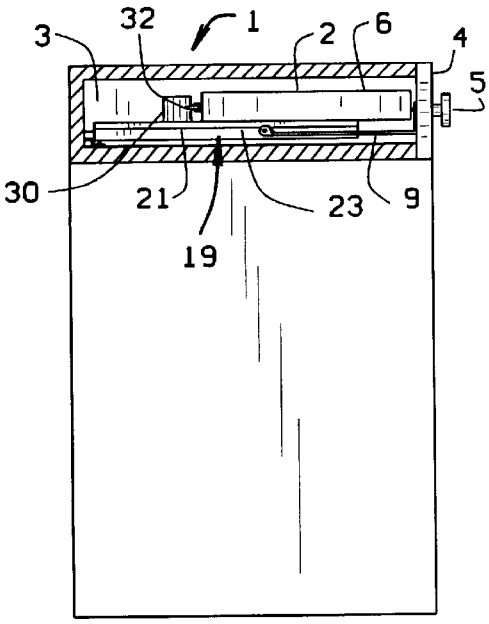
FIG. 1 is a view in side elevation of an ironing board of the present invention in a retracted state.
Figure 2:
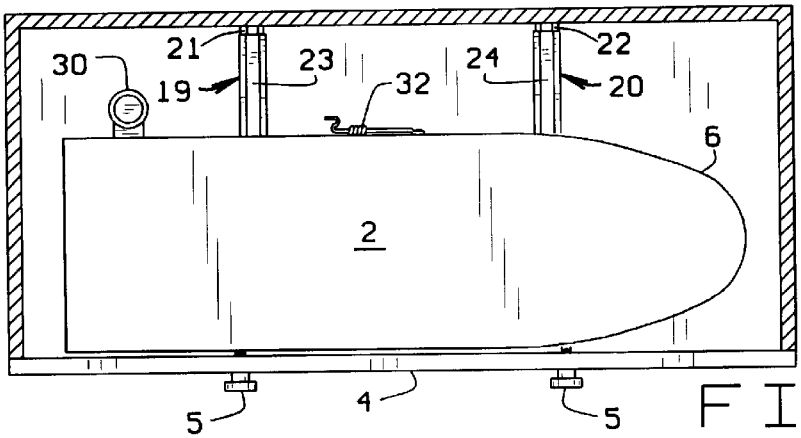
FIG. 2 is a top plan view of an ironing board of the present invention in a retracted state.
Figure 4:
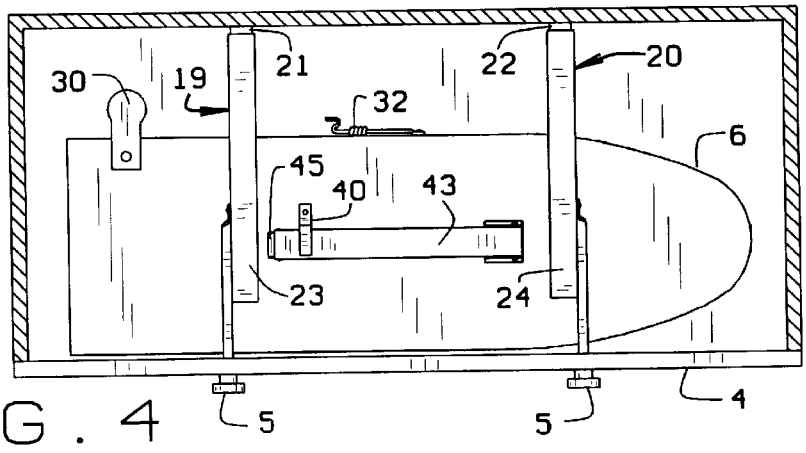
FIG. 4 is a bottom plan view of an ironing board of the present invention in a retracted state.

Referring now the drawings, and in particular to FIGS. 1, 2 and 4, an ironing board assembly 1 of the present invention comprises an ironing surface 2, a set of two rails 19 and 20, and a cabinet face 4 attached to ironing surface 2 by arms 9 and 10. Ironing surface 2 is essentially conventional, having a tapered neck portion 6 at one end and a substantially rectangular portion at the other end. As with most conventional ironing surfaces, ironing surface 2 has rounded comers. The ironing board assembly 1 is encased in a recessed enclosure 3 that is formed as a rectangular box with an open front end. The enclosure 3 is suitable for installation in an existing cabinet, or may be formed as a part integral with a custom made cabinet or dresser. Cabinet face 4 covers the open end of enclosure 3 when the ironing board 1 is in a retracted state. Cabinet face 4 has handles 5 and 7 with which to pull cabinet face 4 forward, extending ironing surface 2 out of enclosure 3 Ironing surface 2 is slideably extendible from enclosure 3 on rails 19 and 20.

Figure 3:
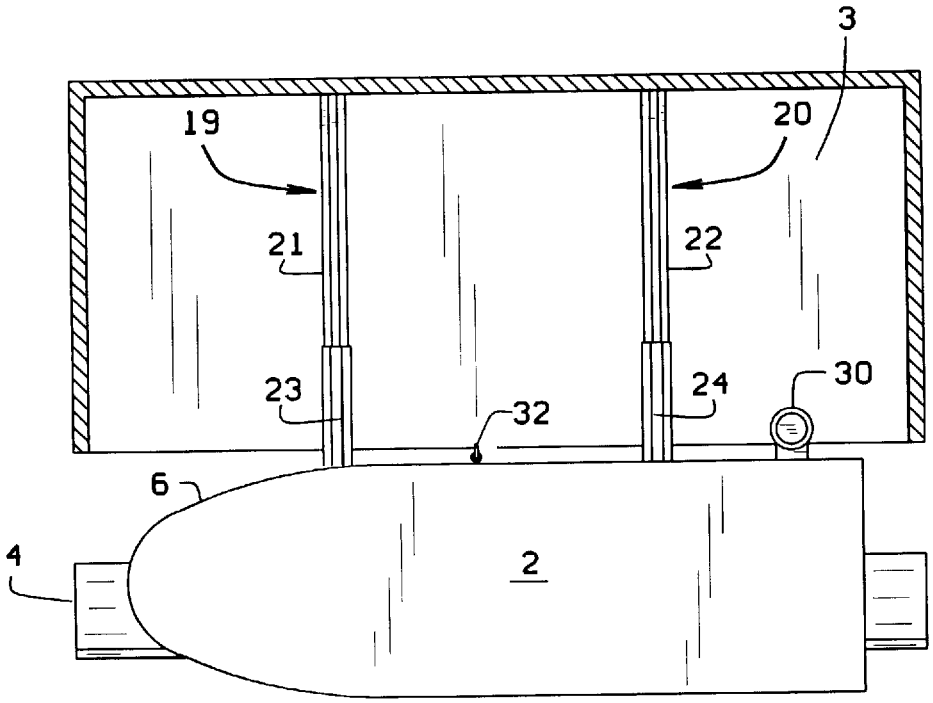
FIG. 3 is a top plan view of an ironing board of the present invention in an extended state.
Figure 6:
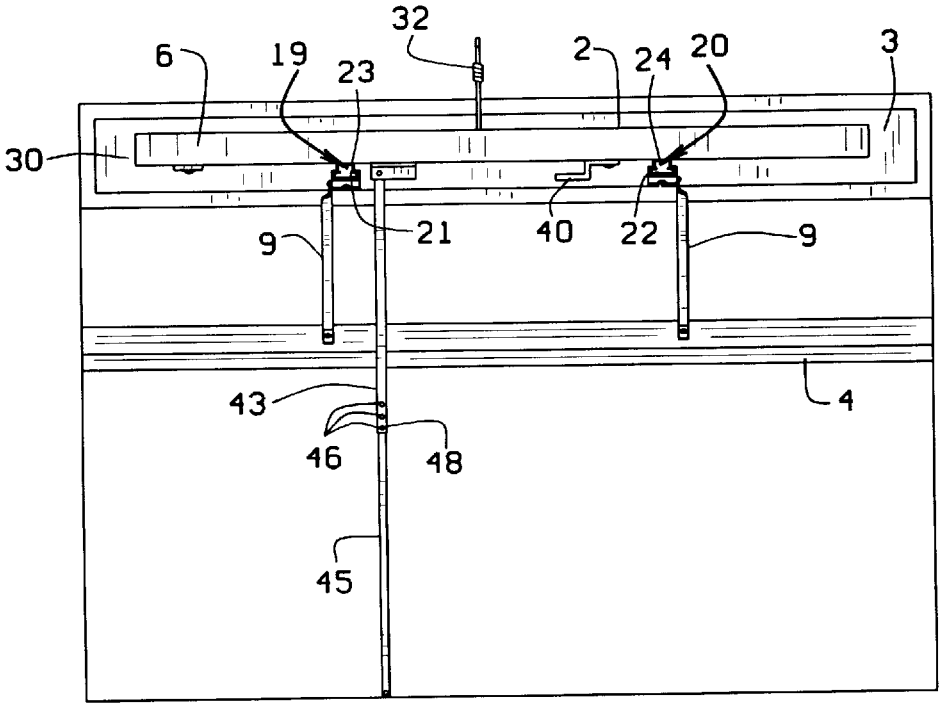
FIG. 6 is a front view of a an ironing board of the present invention in an extended state.

Referring now to FIG. 3 and FIG. 4, Rails 19 and 20 have fixed portions 21 and 22 that are attached to enclosure 3 by way of brackets 17 and 18 respectively, the brackets held to the enclosure by screws or glue or the like, and extendible portions 23 and 24 that are attached to ironing surface 2 by brackets (not shown). Rails 19 and 20 are preferably formed with recessed grooves or channels 25 and 26, with extendible portions 23 and 24 slideably positioned within grooves 25 and 26. Stops 27 and 28 are incorporated into rails 19 and 20 respectively, and serve to prevent the ironing board surface 2 from being pulled completely out of grooves 25 and 26 and enclosure 3. Stops 25 and 26 are releasable, so that the ironing board and extendible rails 23 and 24 may be removed. The releasable stops 27 and 28 are conventional and well known in the cabinetry art.

Adjustable arms 9 and 10 are attached to both the cabinet face 4 and the ironing surface 2. Referring back to FIG. 1, Bracket 14 of arm 9 is attached to the underside of ironing surface 2. Bracket 12 of arm 9 is attached to cabinet face 4. Adjustable arms 9 and 10 are formed with a joint 11 so that when ironing surface 2 is extended by pulling handles 5 and 6 toward the user, cabinet face 4 is moved in a direction beneath the ironing surface 2 by means of joint 11.

In the preferred embodiment of the present invention, the joint 11 is a simple bracket 12 positioned toward the rail 19 of the ironing surface 2, and to arm 9. Another joint 13 is similarly positioned at rail 20 under ironing surface 2 and attached to arm 10. Brackets 12 and 13 are riveted to rails 19 and 20, respectively, and pivot about the rivets. When the cabinet face 4 is pulled away from enclosure 3, the arms 9 and 10 are moved in a downward direction to a point underneath the ironing surface 2, thus moving cabinet face 4 out of the way of ironing surface 2.

It is contemplated that in any embodiment cabinet face 4 is integral with ironing surface 2, being attached by way of arms 9 and 10 with an intermediate joint 11 so that cabinet face 4 is moved underneath ironing surface 2. The provision of an integral cabinet face makes it possible for the user to remove the entire ironing board assembly 1 from the fixed rails 21 and 22 by releasing stops 27 and 28 respectively, thus allowing the installation of a different ironing surface, as in an ironing surface adapted for use in ironing shirt sleeves for example, or a utility drawer into the fixed rails 21 and 22 without requiring the use of tools.

A cup 30 is preferably attached toward the rear of the ironing surface, that is the section opposite the neck of the ironing surface. The cup may be used to hold spray starch, water or other useful canisters.

A wire keeper 32 is positioned toward the rear of ironing surface 2 at the side facing the cabinet recess. Wire keeper 32 pivots from a lower position which is parallel to the plane of the ironing surface 2, to an upper position which is perpendicular to the plane of ironing surface 2. Wire keeper 32 is well known in the ironing board art.

Figure 5:
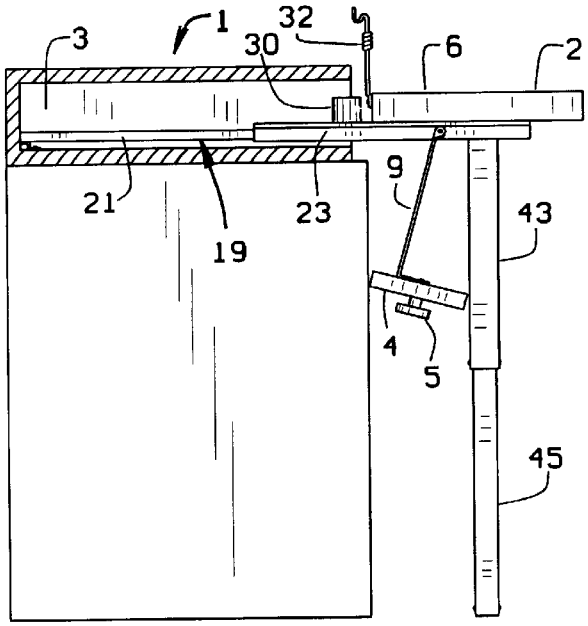
FIG. 5 is a view in side elevation of an ironing board of the present invention in an extended state.

Referring to FIG. 4 and FIG. 5, an optional leg 36 has an attached end 38 toward the neck portion 6 of ironing surface 2 and a free end 39. Attached end 38 of leg 36 is attached to ironing surface 2 by means of joint 37 at attached end 38. When ironing surface 2 is in a position retracted within enclosure 3, the leg 36 is positioned parallel to the plane of ironing surface 2, that is to say the leg 36 is substantially horizontal. A keeper 40 holds leg 36 in place when leg 36 is parallel to ironing surface 2. Keeper 40 is a flat sheet of metal that is riveted to the under side of ironing surface 2, so as to be movable from a position covering leg 36 to a position uncovering leg 36. When the ironing surface 2 is extended from enclosure 3, the leg 36 is moved from the horizontal position to a position perpendicular to the plane of the ironing surface 2 to a distance sufficient to touch the ground, thus providing greater stability to ironing surface 2. Leg 36 is preferably made in two sections, an outer section 43 and an inner section 45 that telescopes from outer section 43. A plurality of openings 46 in outer section 43 of leg 36 receive a spring biased stop 48, so that inner section 45 is removably fixed at a number of pre-selected positions, depending upon the desired height of the leg 36.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative, and not in a limiting sense.

What is claimed is:

1. An ironing board comprising:

an enclosure formed as a rectangular box having an open front;

an ironing surface within the enclosure;

rails within the enclosure with a fixed portion mounted to the enclosure and an extendible portion mounted to the ironing surface; and a cabinet face covering the front open end of the enclosure, said cabinet face attached to the ironing surface with adjustable arms, said adjustable arms being pivotable about a joint to move the cabinet face underneath the ironing surface when the ironing surface is extended from the enclosure.

2. The ironing board of claim 1 wherein the joint of the adjustable arms attached to the cabinet face and the ironing surface comprises a bracket rotatable around a central axis, and a rivet is attached to a rail of the ironing board assembly, the bracket being rotatable about the rivet such that the cabinet face is positioned underneath and away from a neck of the ironing surface when the ironing surface is extended.

3. The ironing board of claim 1 wherein a movable leg depends from the ironing surface, the leg being movable with respect to the ironing surface so that the leg is movable from a position parallel to the plane of the ironing surface to a position perpendicular to the plane of the ironing surface when the ironing surface is extended from the enclosure.

4. The ironing surface of claim 1 further including a removable cup disposed at a side of the ironing surface.

5. The ironing surface of claim 1 further including a wire keeper disposed at a side of the ironing surface.

6. An ironing board comprising:

an enclosure formed as a rectangular box having an open front;

an ironing surface having a neck portion and a back portion, said ironing surface movable from a point within the enclosure to a point outside the enclosure;

rails within the enclosure with a fixed portion mounted to the enclosure and an extendible portion mounted to the ironing surface;

a movable cup disposed at a side of the ironing surface;

a wire keeper disposed at another side of the ironing surface; and a cabinet face covering the front end of the enclosure, said cabinet face attached to the ironing surface with adjustable arms, said adjustable arms being pivotable about a joint to move the cabinet face underneath the ironing surface when the ironing surface is extended from the enclosure.

* * * * *